US008915572B2

(12) United States Patent
Levi

(10) Patent No.: US 8,915,572 B2
(45) Date of Patent: Dec. 23, 2014

(54) PRINTHEAD ADAPTER FOR PIGMENTED INK

(71) Applicant: Yaakov Levi, Kefar Yona (IL)

(72) Inventor: Yaakov Levi, Kefar Yona (IL)

(73) Assignee: Dip-Tech Ltd., Kefar Sava (IL)

( * ) Notice: Subject to any disclaimer, the term of this patent is extended or adjusted under 35 U.S.C. 154(b) by 0 days.

(21) Appl. No.: 13/772,477

(22) Filed: Feb. 21, 2013

(65) Prior Publication Data

US 2013/0222494 A1 Aug. 29, 2013

Related U.S. Application Data

(60) Provisional application No. 61/602,187, filed on Feb. 23, 2012.

(51) Int. Cl.
*B41J 2/165* (2006.01)
*B41J 2/18* (2006.01)
*B41J 2/175* (2006.01)

(52) U.S. Cl.
CPC ..... *B41J 2/18* (2013.01); *B41J 2/17523* (2013.01); *B41J 2/1752* (2013.01)
USPC ..... 347/28; 347/89

(58) Field of Classification Search
USPC ..... 347/7, 28, 29, 89, 84–87
See application file for complete search history.

(56) References Cited

U.S. PATENT DOCUMENTS

| | | | | |
|---|---|---|---|---|
| 6,142,601 | A * | 11/2000 | Sharma et al. | 347/28 |
| 6,164,751 | A * | 12/2000 | Griffin et al. | 347/28 |
| 6,188,417 | B1 | 2/2001 | Keefe et al. | |
| 6,322,207 | B1 * | 11/2001 | Hall et al. | 347/85 |
| 6,464,346 | B2 * | 10/2002 | Otis et al. | 347/85 |
| 6,478,415 | B2 * | 11/2002 | Barinaga et al. | 347/85 |
| 6,497,472 | B2 * | 12/2002 | Sharma et al. | 347/28 |
| 7,147,314 | B2 | 12/2006 | Anderson, Jr. et al. | |
| 8,113,637 | B2 * | 2/2012 | Yokouchi | 347/85 |

FOREIGN PATENT DOCUMENTS

| | | |
|---|---|---|
| EP | 0 863 017 A2 | 9/1998 |
| EP | 1 306 220 A1 | 5/2003 |

* cited by examiner

*Primary Examiner* — Anh T. N. Vo
(74) *Attorney, Agent, or Firm* — Vorys, Sater, Seymour and Pease LLP; William L. Klima

(57) ABSTRACT

An inkjet printhead adapter, including a chassis operative to accommodate one or more printheads and include one or more ink recycling valves and one or more ink supply valves communicating with an ink reservoir via an ink feeding tube and with one or more printhead accommodated in the adapter and wherein the ink supply valve is operative to direct a flow of ink from the feeding tube to one or more of the printhead and the ink recycling valve.

22 Claims, 7 Drawing Sheets

PRINTHEAD ADAPTER FOR PIGMENTED INK

TECHNICAL FIELD

The current method and apparatus relate to printhead adapters and in particular to printhead adapters for pigmented inks.

BACKGROUND

Pigment loaded ink is relatively new in industrial printing used for its advantages such as being environmentally friendly, durable, rapidly drying, non-fading and having low bleeding tendencies.

Pigmented ink, however, may also require special handling. Pigments, being solid particles, tend to settle and aggregate which may lead to packing of the sediments. This can have a great impact on the quality of the finished product (concentration gradients, blocking of the jet leading to inconsistency of the color, etc.). For example, white ink containing Titanium Oxide (TiO2) is the most widely used white pigment because of its brightness and very high refractive index. However, TiO2 may have a high sedimentation rate, which in some cases, for example may be 10-20 mg/hour.

In the glass-printing industry, special ink compositions are used for long lasting glass printing, which commonly include micro and/or nano-particles of glass or ceramics (frits), wherein the fixation of the printed image is by firing the printed glass in a furnace at high temperatures of 550° C. and more. The exposure of the ink to such high temperatures causes the glass micro particles to melt, thus affixing the ink pigments into the printed glass surface.

Traditionally, industrial large format printing on substrates such as paper, glass, stone and others was performed using screen-printing and smearing of the ink over the screen. Currently, printing technology is shifting to digital inkjet printing to reduce costs, eliminating screen and film storage space and improve yield, consistency and time to market.

However, printheads include ink conducting channels having micro-scale diameters and an ink delivery mechanism based on pressure gradients and capillarity highly sensitive to clogging and packing by debris and ink drying. Employing pigmented ink and in some cases a mixture of pigment and frits in the inkjet printing environment poses a challenge since it may bring about aggregation and sedimentation of the pigment particles and, in some cases frits, in the ink delivery and circulation tubes as well as packing of the sediments in the tubes and printhead nozzles.

For the reasons discussed above printing with pigmented ink and especially ceramic ink, i.e., pigmented ink mixed with glass or ceramic micro and/or nano-particles, cannot be carried out with a standard inkjet printhead and the printhead needs to be adapted so that to allow smooth operation with a minimum of ink settling and aggregating and/or packing of the sediments.

The common inkjet printhead spatial calibration process currently practiced in printers employing more than one printhead in the printing run involves individually calibrating each printhead relative to a bracket, which in turn is connected to an insert using registration pins and registration holes. The insert is then connected to a printer, e.g., mounted on a reciprocating carriage or static bridge. This three-step process allows for a cumulative error in the printheads spatial calibration.

SUMMARY

The present method and apparatus seek to provide an inkjet printhead adapter operative to accommodate one or more printheads.

There is thus provided in accordance with an example of the current method and apparatus an inkjet printhead adapter, which includes a chassis and one or more ink recycling valves and one or more ink supply valves communicating with an ink reservoir via an ink feeding tube and supplying ink such as pigmented ink, including micro and/or nano-particles of at least one of pigment, glass and ceramics to the printhead. The recycling phase can allow continuous recycling of the pigmented ink to maintain the particles in suspension.

In accordance with another example the adapter also includes one or more washing solvent supply valve and one or more washing solvent draining valves communicating with a solvent reservoir via a solvent feeding tube and with one or more printhead accommodated in the adapter so that to enable a flow of solvent from the solvent supply valve through the printhead to the draining valve.

In accordance with yet another example the adapter the solvent feeding tube valve and the draining valve can direct the flow of solvent through one or more of the printhead main ink channel and the nozzles.

In accordance with still another example the adapter could include a network of tubes at least part of which can be at least an integral part of, be passageways within or be external to the chassis.

In accordance with another example one or both ink supply valve and the ink recycling valve are placed in close as possible proximity to the printhead nozzles so that to minimize the volume of a column of ink between the valve and the nozzles.

In accordance with yet another example the adapter chassis can also include one or more registration pins and registration pin holes. One or more printheads can be spatially pre-calibrated relative to the adapter at the adapter manufacturing level and one or more registration pins and registration holes can be placed at locations determined by the calibration/alignment process so that a batch of printheads accommodated in the adapter can be automatically calibrated accordingly.

In accordance with still another example there is provided a method for preventing sedimentation and packing of ink particles that includes providing an inkjet printhead adapter including valves, tubes and passageways and continuously recycling the ink and maintaining the particles in suspension.

In accordance with another example there is also provided a method for preventing sedimentation and packing of ink particles, clogging of ink passageways in a printhead adapter and printhead and preventing waste of ink, which includes positioning one or more ink supply valves and the ink recycling valves as close as possible to the printhead nozzles minimizing the volume of a column of ink between the valve and the nozzles.

In accordance with another example there is also provided a method for washing a printhead ink passageways and nozzles including providing one or more washing solvent supply valves and one or more washing solvent draining valves communicating with a solvent reservoir via a solvent feeding tube and with one or more printheads accommodated in the adapter and directing a flow of solvent from the solvent supply valve only through the printhead ink passageways and main ink channel separately from or together with the printhead nozzles.

In accordance with another example there is also provided a method for batch calibrating a batch of printheads accommodated in an adapter including pre-calibrating one or more printheads relative to the adapter, placing registration pins and registration holes at locations determined by the calibration/alignment process so that a batch of printheads accommodated in the adapter can be automatically calibrated accordingly.

BRIEF DESCRIPTION OF THE DRAWINGS

The present method and apparatus will be understood and appreciated more fully from the following detailed description, taken in conjunction with the drawings in which like numerals depict the same elements throughout the text of the specifications.

DETAILED DESCRIPTION

Figure 1:
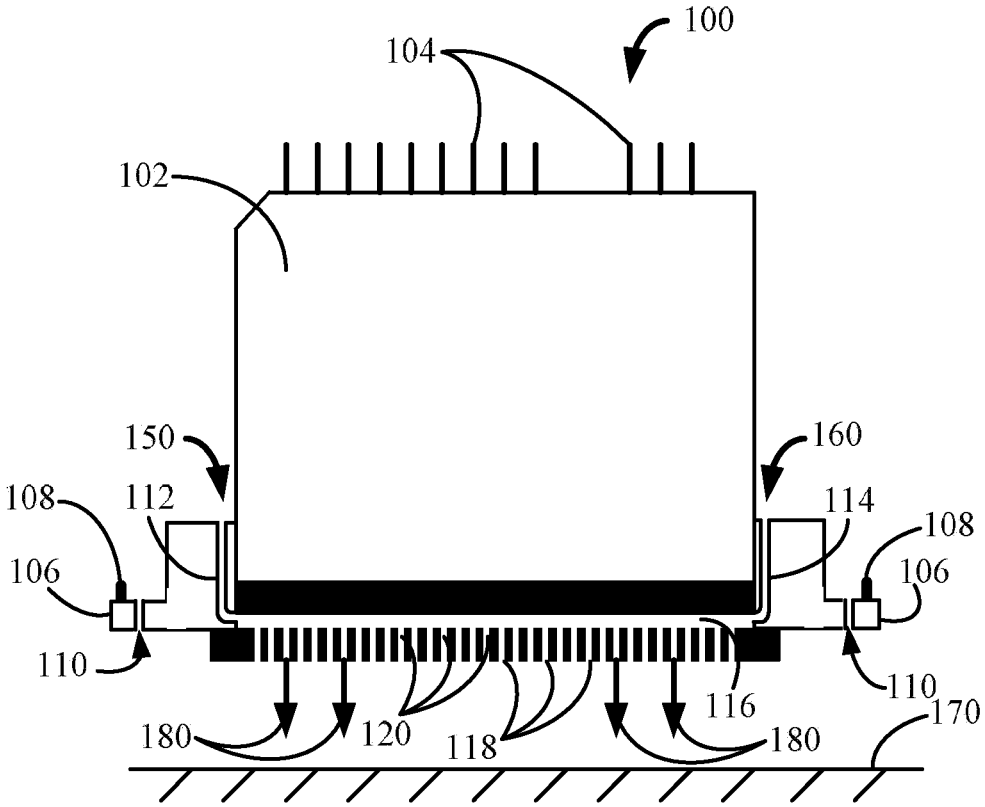
FIG. 1 is a cross sectional view simplified illustration of a typical industrial printhead in accordance with an example.

Reference is now made to FIG. 1, which is a cross sectional view simplified illustration of a typical industrial printhead in accordance with an example. As shown in FIG. 1, a printhead 100 may include a body 102, printhead-printer electric interface or connector pins 104 and printhead-printer attachment ears 106. Attachment ears 106 may also include one or more registration pins 108, registration pin holes 110 or both.

During printing, ink may be fed from a printer ink feeding tube (not shown) into one or both printhead ink feeding tubes 112 and 114, in a direction indicated by arrows designated reference numerals 150 and 160. The ink may fill main ink flow channel 116 and printhead ink conducting channels 120 and be deposited via nozzles 118 on to a substrate 170 as indicated by arrows designated reference numeral 180.

The ink may be delivered to and held in a steady state in printhead ink conducting channels 120, ink feeding tubes 112 and 114 and main ink flow channel 116 by a delicate balance between a weak sub-atmospheric pressure (e.g., 30-40 mm $H_2O$) and gravity and in some cases capillary forces developed by the micro-scaled size of ink channels 120.

Sedimentation or aggregation and packing of pigmented and/or ceramic ink may occur disrupting this delicate balance (e.g., resulting in leaking of ink) and/or clogging anyone of ink conducting channels 120, ink feeding tubes 112 and 114, main flow channel 116 and nozzles 118 causing printhead 100 to malfunction.

Figure 2:
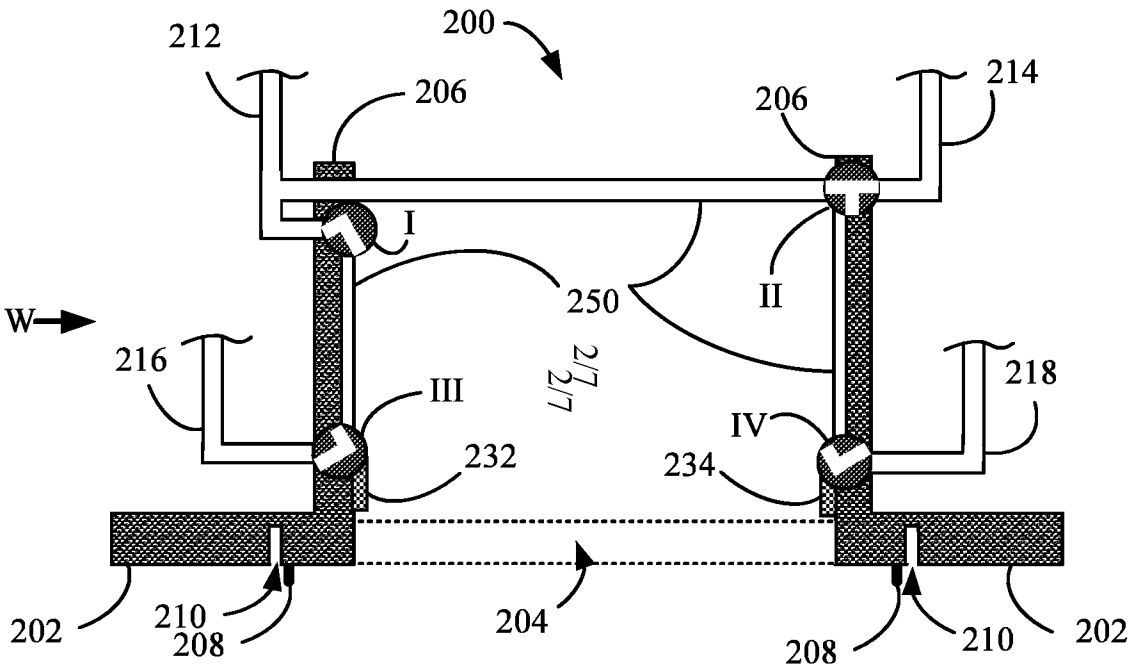
FIG. 2 is a cross sectional view simplified illustration of an adapter for an industrial printhead in accordance with another example.

Reference is now made to FIG. 2, which is a cross sectional view simplified illustration of an adapter for an industrial printhead in accordance with another example. An adapter 200 can include a chassis 202, having one or more openings 204 defined by walls 206 configured to accommodate one or more industrial printheads such as printhead 100 of FIG. 1. Chassis 202 may include one or more registration pins 208 configured to be accommodated in printhead 100 registration pin holes 110 (FIG. 1). This allows precise positioning of printhead 100 relative to adapter 200 and may save time and effort calibrating printhead 100 as will be described in detail below. Alternatively or additionally, chassis 202 may also include registration pin holes 210 configured to accommodate printhead 100 registration pins 108 (FIG. 1). Chassis 202 may also include means (not shown) for attaching chassis 202 to a printer, e.g., mounted on a reciprocating carriage or static bridge.

Adapter 200 may also include one or more valves including one or more ink supply valves I, ink recycling valves II, printhead washing solvent supply valves III and washing solvent draining valves IV all mounted on chassis 202. Ink supply valve I is configured to receive pigmented ink from an ink reservoir (not shown) via feeding tube 212 and direct a flow of pigmented ink from the ink feeding tube (112) to at least one of the printhead (100) or the pigmented ink recycling valve (II). Ink recycling valve II can drain the ink from the printhead via an ink draining tube 214, recycling the ink into the system by, for example, returning the ink to the ink reservoir. Washing solvent supply valve III is configured to communicate with washing solvent reservoir (not shown) via a washing solvent feeding tube 216. The washing solvent supply valve (III) is also configured to direct a flow of washing solvent from the washing solvent supply valve (III) through the printhead (100) to the draining valve (IV). Washing solvent draining valve IV can drain the washing solvent to a waste collection reservoir (not shown) via a draining tube 218.

Each of the ink supply valve I and ink recycling valve II pair and the printhead washing solvent supply valve III and washing solvent draining valve IV pair may communicate with each other by a network of tubes 250 as will be described in greater detail below. The network of tubes may also communicate with a printhead accommodated within opening 204 via fluid connectors 232 and 234 that may attach to corresponding ink feeding tubes 112 and 114 (FIG. 1). Part or the entire network of tubes 250, valves I, II, III and IV and fluid connectors 232 and 234 may be an integral part of chassis 202, be passageways within or may be external to chassis 202 and attached thereto.

Placing valves I and II within adapter 200 and in close proximity to printhead 100 nozzles 118 minimizes the volume of the column of ink between valves I/II and nozzles 118, minimizes ink sedimentation and ink waste and prevents ink leaks and dripping as will be explained in detail below.

Printhead 100 may also include all tubing, electric and other connectors and adapters required to interface printhead 100 with a printer.

Figure 3:
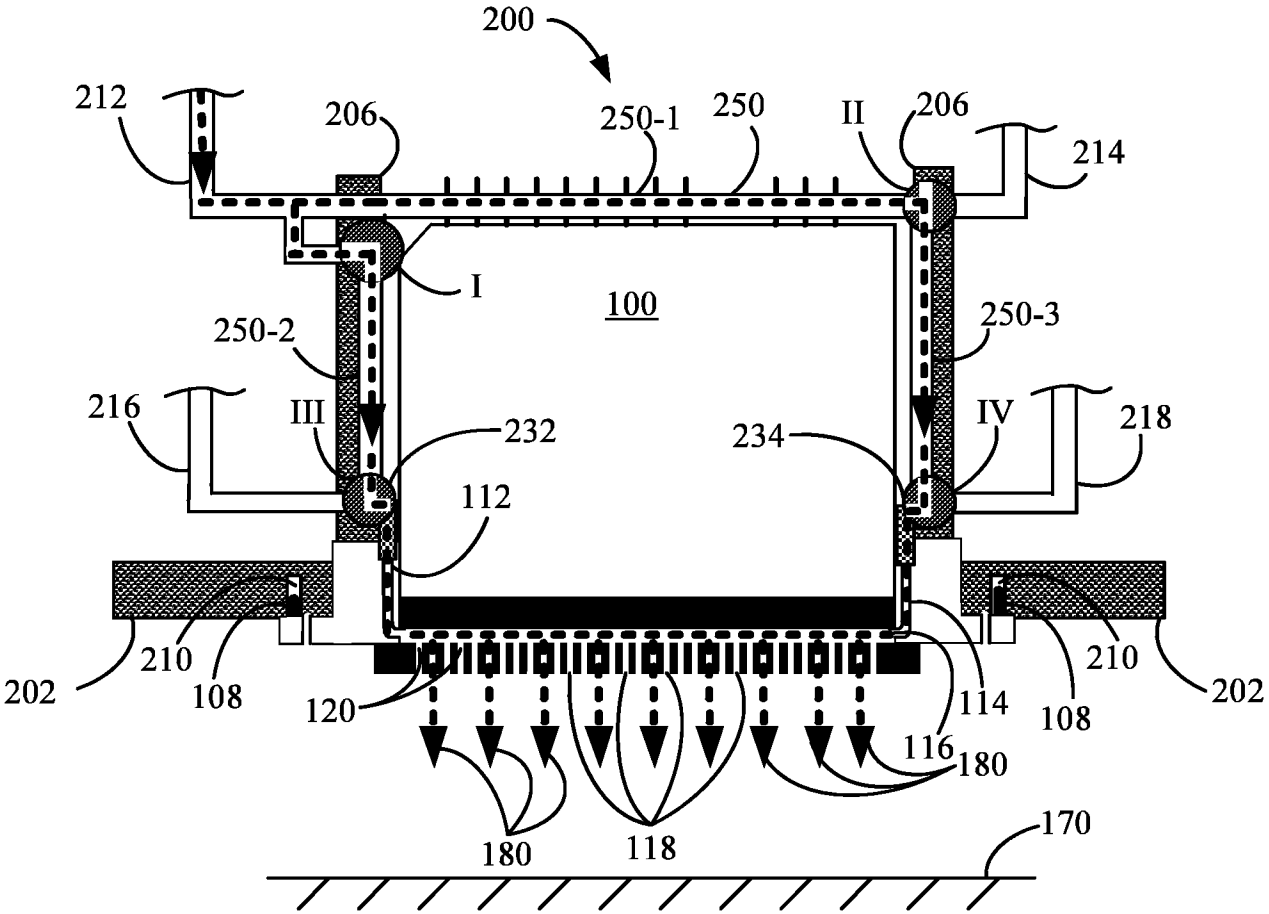
FIG. 3 is a cross sectional view simplified illustration of an implementation in the printing phase of an adapter for an industrial printhead in accordance with yet another example.

Referring now to FIG. 3, which is a cross sectional view simplified illustration of an implementation in the printing phase of an adapter for an industrial printhead in accordance with yet another example. As shown in FIG. 3, printhead 100 is accommodated by adapter 200 by being inserted into opening 204. Registration pins 108 are inserted into registration pin holes 210 and fluid connectors 232 and 234 are connected to corresponding ink feeding tubes 112 and 114 allowing flow of ink from network 250 into printhead 100.

Valves I-IV could be two or three way valves and may have several positions that control the direction of flow of ink or washing fluid depending on the phase of operation of printhead 100/adapter 200. In the example depicted in FIG. 2, valve II is a three way valve and valves I, III and IV are two way valves. In the printing phase depicted in FIG. 3, printhead washing solvent supply valve III and washing solvent draining valve IV may be closed while valves I and II may be set in a position allowing ink supplied from an ink reservoir (not shown) to flow along a route indicated by broken arrows via feeding tube 212, through ink supply valve I into printhead supply tubes 250-2 and 250-3, through fluid connectors 232 and 234 into printhead 100 ink feeding tubes 112 and 114. In the example depicted in FIG. 3, bridge 250-1, connecting valves I and II can remain open at all phases of operation. The ink may remain in main ink flow channel 116 and printhead ink conducting channels 120 under a steady state until injected through nozzles 118 as indicated by arrows designated reference numeral 180 on to a substrate 170 by methods known in the art. Alternatively ink circulation in main channel could be maintained by supplying ink through one of the ink feeding tubes 112 or 114 and using the other one as in outlet tube.

When printing is temporarily suspended, for example for 5 or more minutes, and printhead 100 temporarily not used, the ink no longer flows as described above. When pigmented ink is stagnant the solid particles, as described above, may begin to settle and/or aggregate. To prevent this phenomenon the ink may be circulated keeping the pigment particles as well as glass or ceramic micro and/or nano-particles in suspension.

Figure 4:
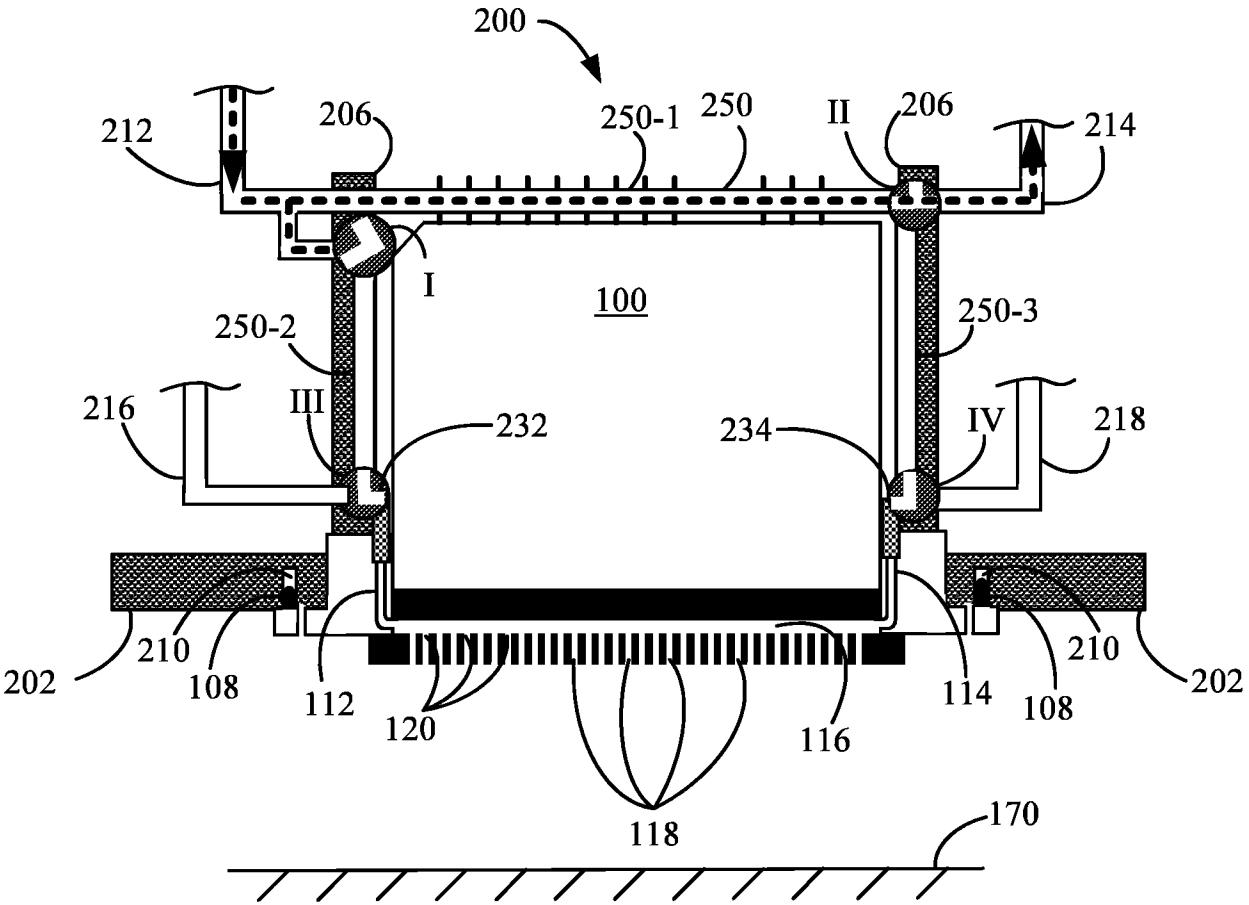
FIG. 4 is a cross sectional view simplified illustration of an implementation in the ink circulation phase of an adapter for an industrial printhead in accordance with still another example.

As depicted in FIG. 4, which is a cross sectional view simplified illustration of an implementation in the ink circulation phase of an adapter for an industrial printhead in accordance with still another example, printhead 100 adapter 200 may allow continuous pigmented ink circulation when printing is temporarily suspended. This is to maintain particles of pigment, glass or ceramics (frits) in suspension and prevent sedimentation.

In the ink circulation phase ink recycling valve II is opened, while ink supply valve I, printhead washing solvent supply valve III and washing solvent draining valve IV are closed. Valve II can be set in a position allowing ink supplied from an ink reservoir (not shown) to flow along a route indicated by broken arrows via feeding tube 212, into bridge tube 250-1 through ink recycling valve II and via ink draining tube 214, recycling the ink into the system by, for example, retuning the ink to the ink reservoir. At this stage, printhead 100 may be removed and replaced as desired or washed with a solvent as will be described in greater detail below.

Printing may be suspended for variable time intervals during or in between print jobs at which time maintenance of the printhead may be carried out to clear the printhead feeding tubes passages from debris (e.g., sedimentation) and ink remnants and residues to prevent their drying, packing and clogging main ink flow channel 116, printhead ink conducting channels 120 and nozzles 118. This extends the operating life of the printhead and prepares it for the next print job.

Figure 5A:
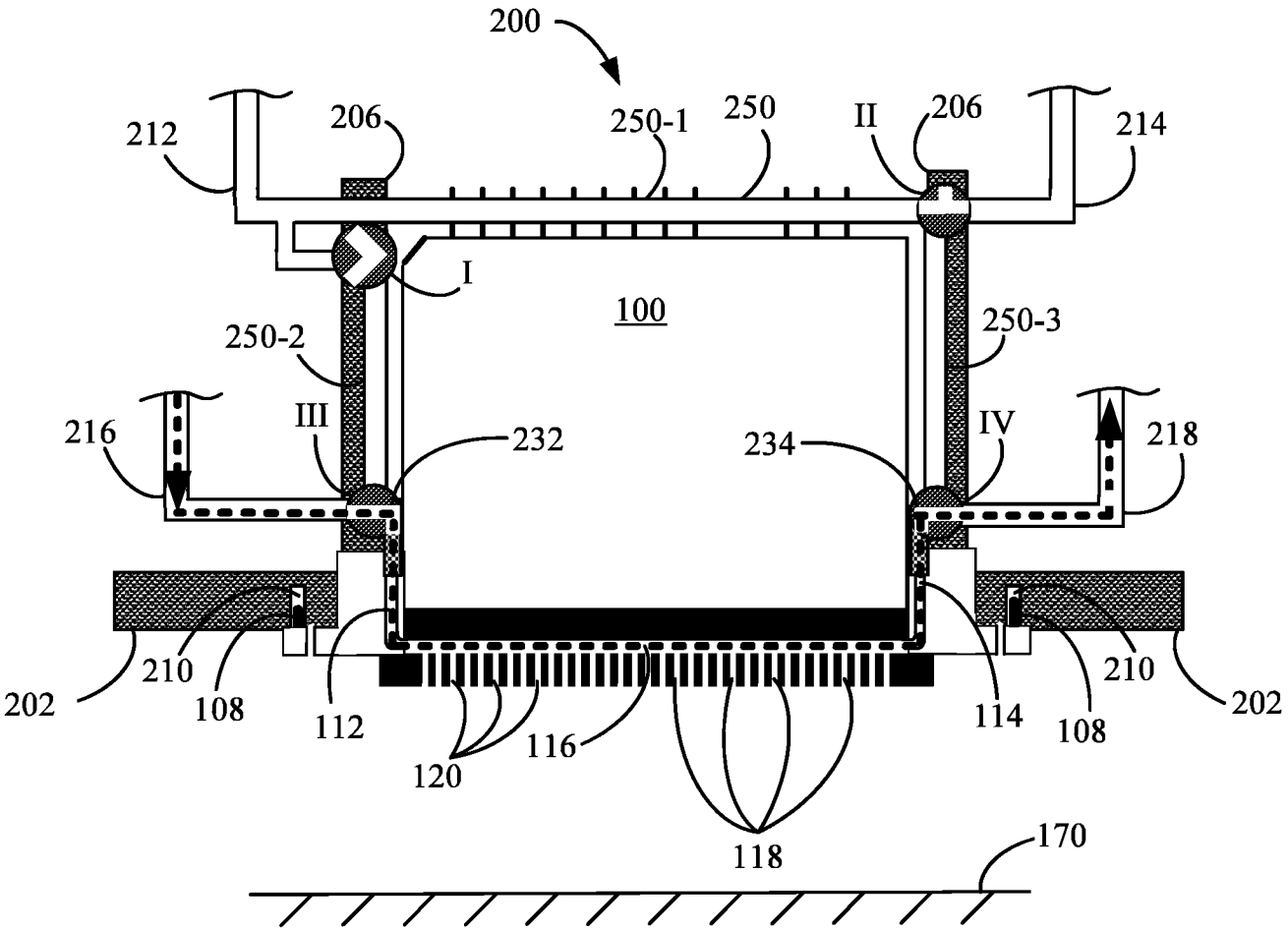
FIGS. 5A and 5B are cross sectional view simplified illustrations of an implementation in the printhead washing phase of an adapter for an industrial printhead in accordance with another example.
Figure 5B:
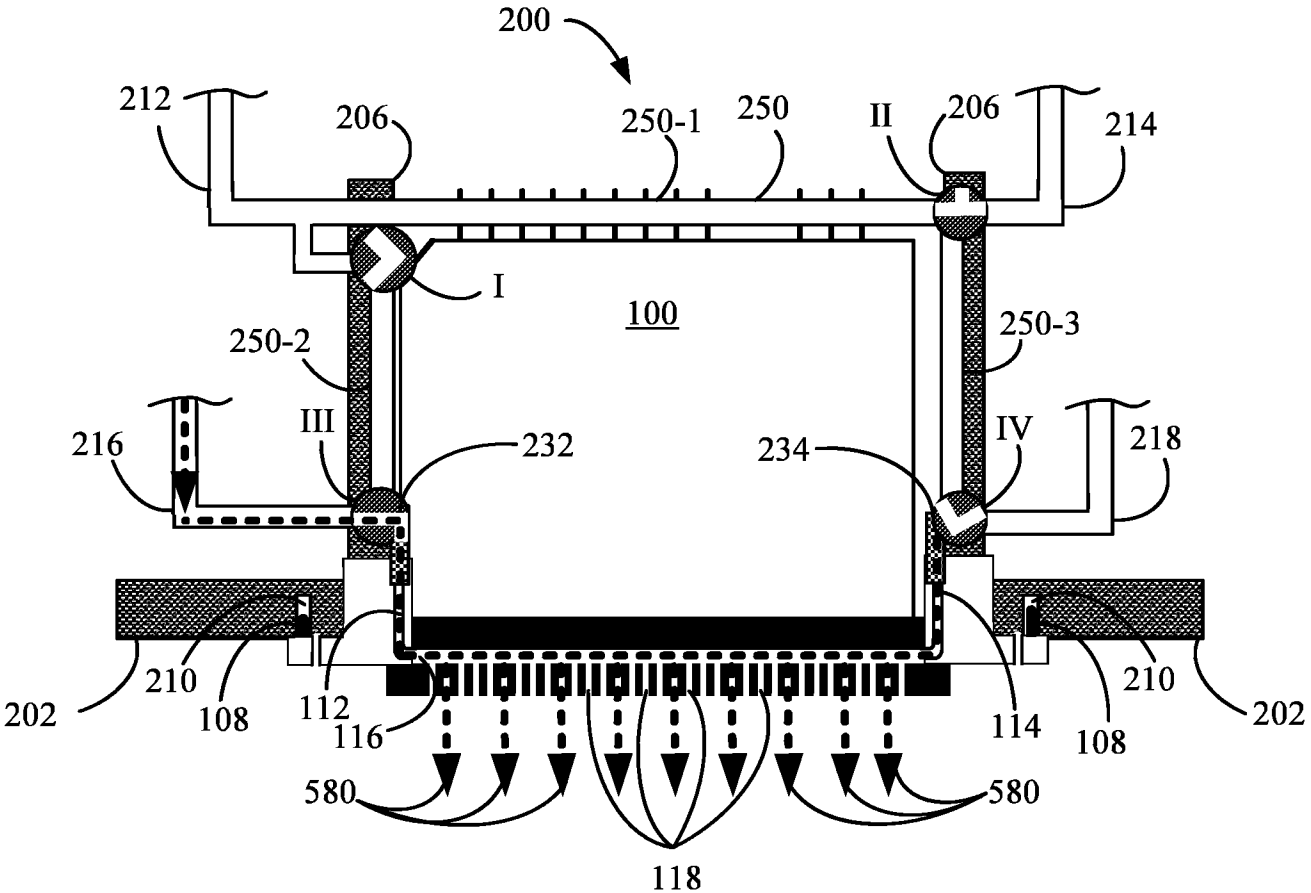

Reference is now made to FIGS. 5A and 5B, which are cross sectional view simplified illustrations of an implementation in the printhead washing phase of an adapter for an industrial printhead in accordance with other examples.

As shown in FIG. 5A, Printhead 100 may be washed by directing a washing fluid or a solvent from a solvent supply (not shown) via washing fluid feeding tube 216, through washing fluid supply valve III into printhead 100 feeding tube 112, main ink flow channel 116, feeding tube 114, valve IV through washing fluid draining valve IV via draining tube 218 to a waste collection reservoir (not shown). Additionally or alternatively and as depicted in FIG. 5B, valve IV may be set to stop the flow of washing solvent to draining tube 218. In this configuration, the washing fluid pressure within main ink flow channel 116 and printhead ink conducting channels 120 may build up forcing the washing fluid through nozzles 118 as indicated by arrows designated reference numeral 580 clearing nozzles 118 from ink remnants and residues. The washing channel and ink delivery and bypass channels are independent channels ink circulation and printhead washing could take place sequentially or simultaneously, as it could be dictated by a particular protocol.

Both the printhead washing phase (FIGS. 5A and 5B) and the ink circulation phase (FIG. 4) as described above may be carried out simultaneously.

Figure 6:
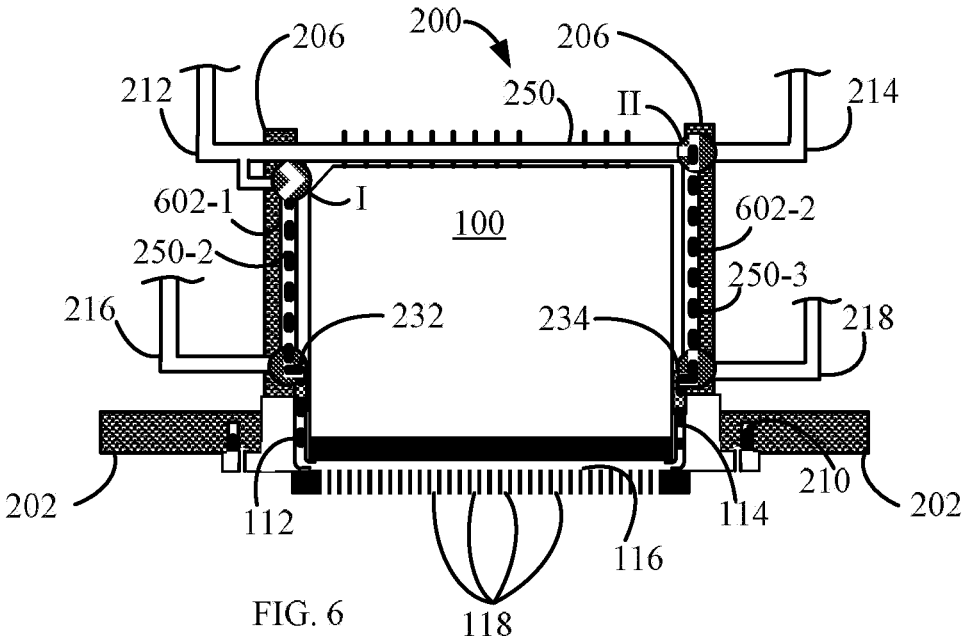
FIG. 6 is a cross-section view simplified illustration of a printhead accommodated by an adapter for an industrial printhead in accordance with still another example.

As shown in FIG. 6, which is a cross-section view simplified illustration of a printhead 100 accommodated by an adapter 200 for an industrial printhead in accordance with still another example, placing valves I and II within adapter 200 and in close proximity to printhead 100 nozzles 118 minimizes the volume of ink columns 602-1/602-2 to a volume commonly below 5 ml, more commonly below 4 ml and even more commonly below 3 ml, as indicated by broken lines between valves I/II and printhead main ink flow channel 116. The shorter the ink column, i.e., the lesser the volume of pigmented ink remaining in network of tubes 250, the less chance for sedimentation and aggregation of pigment, glass and ceramic micro and/or nano-particles and the less incidents of printhead malfunction due to packing of the sediments in the printhead passageways such as feeding tubes 112/114, main ink flow channel 116, printhead ink conducting channels 120 and nozzles 118. Additionally, the shorter the ink column 602-1/602-2—the less the volume of ink wasted should printhead 100 need to be removed or washed as described above.

In some industrial jet printing printheads, the ink is maintained in main ink channel 116 and printhead ink conducting channels 120 by an equilibrium between the force of gravity and a weak sub-atmospheric pressure (e.g., 30-40 mm $H_2O$) as well as capillary forces. When printing is suspended, air under atmospheric pressure may enter the system (e.g., via one or more nozzles 118) bringing about a loss of the delicate equilibrium (e.g., by causing loss of vacuum) bringing about leakage and dripping of ink, for example, ink columns 602-1/602-2 from nozzles 118. The placement of ink valves I/II in close proximity to nozzles 118 and closing them may allow holding the ink along tubes 250-2/250-3, at least for a limited time, in cases when negative pressure in the printhead is lost, e.g., when printing is suspended preventing leakage and dripping of ink (i.e., ink columns 602-1/602-2) from nozzles 118.

Figure 7:
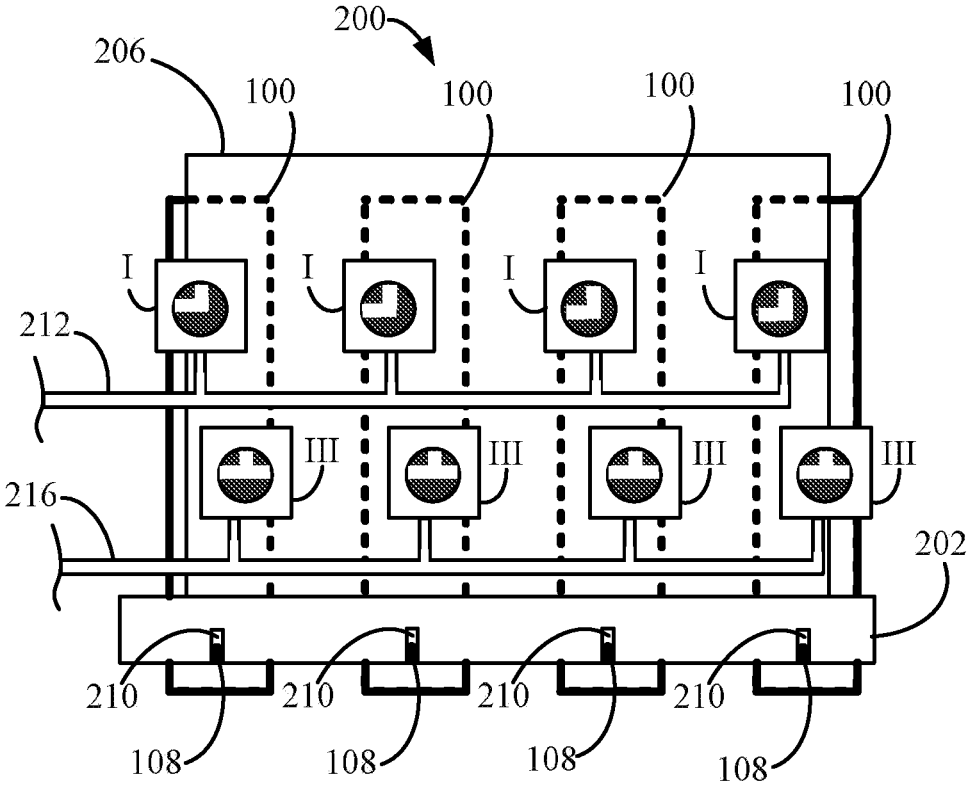
FIG. 7 is a side view simplified illustration of an adapter for a batch of industrial printheads in accordance with yet another example.

Referring now to FIG. 7, which is a side view simplified illustration of an adapter for a batch of industrial printheads similar to the adapter of FIG. 2 viewed from the direction indicated by arrow (W) in accordance with yet another example.

The common inkjet printhead spatial calibration process currently practiced in printers employing more than one printhead in a printing run involves individually calibrating each printhead relative to a respective bracket, which in turn is connected to an insert using registration pins and registration holes. The insert is then connected to a printer, e.g., mounted on a reciprocating carriage or static bridge. This three-step process allows for a cumulative error in the printheads spatial calibration.

As seen in FIG. 7, adapter 200 may accommodate two, four, six or more printheads 100 portions of which hidden by wall 206 outlined in FIG. 7 by phantom lines. Chassis 202 may include one or more registration pins 208, registration pin holes 210 or both. FIG. 7 depicts a number of pinholes 210 accommodating one or more registration pins 108.

Adapter 200 may, at the manufacturing level, be spatially pre-calibrated relative to the printer and registration pins 208/holes 210 placed at locations determined by the calibration process.

Printheads 100 may then be each directly attached to adapter 200 and spatially calibrated relative to adapter 200 and to each other employing registration pins 208/holes 210 thus obviating a bracket or any other intermediate mechanism.

Employing an adapter such as adapter 200 of FIG. 7 saves calibration time and effort by connecting each printhead directly to adapter 200. For example, when changing one or more printhead is required, the new printhead or batch of printheads can be automatically spatially calibrated relative to the printer based on the calibration of the previous printhead at the corresponding location in adapter 200.

It will be appreciated by persons skilled in the art that the present method and apparatus is not limited to what has been particularly shown and described hereinabove. Rather, the scope of the includes both combinations and sub-combinations of various features described hereinabove as well as modifications and variations thereof which would occur to a person skilled in the art upon reading the foregoing description and which are not in the prior art.

I claim:

1. An inkjet printhead adapter, comprising:

a chassis operative to accommodate at least one printhead; and comprises at least one pigmented ink recycling valve; and at least one pigmented ink supply valve communicating with an ink reservoir via an ink feeding tube and with the at least one printhead accommodated in the adapter, the ink supply valve being operative to direct a flow of pigmented ink from the feeding tube to at least one of the at least one printhead and the pigmented ink recycling valve;

at least one washing solvent draining valve;

at least one washing solvent supply valve communicating with a solvent reservoir via a solvent feeding tube and with the at least one printhead accommodated in the adapter, the solvent supply valve being operative to direct a flow of solvent from the solvent supply valve through the at least one printhead to the washing solvent draining valve.

2. The adapter according to claim 1, wherein at least one of the solvent feeding tube valve and the at least one draining valve is operative to direct a flow of solvent through at least one of a main ink channel and a printhead nozzle.

3. The adapter according to claim 1, wherein the pigmented ink comprises micro and/or nano-particles of at least one of pigment, glass and ceramics.

4. The adapter according to claim 1, wherein the ink supply valve and ink recycling valve are operative to allow continuous recycling of the pigmented ink and maintain pigment particles in suspension.

5. The adapter according to claim 1, wherein the adapter also comprises a network of tubes at least part of which are at least one of an integral part of, or passageways within or external to the chassis.

6. The adapter according to claim 1, wherein at least one of the pigmented ink supply valve and the pigmented ink recycling valve are placed in close proximity to printhead nozzles to minimize a volume of a column of ink between one of the valves and the printhead nozzles to a volume less than 5 ml.

7. The adapter according to claim 1, wherein a volume of a column of ink between one of the valves and the printhead nozzles is less than 4 ml.

8. The adapter according to claim 1, wherein a volume of a column of ink between one of the valves and the printhead nozzles is less than 3 ml.

9. The adapter according to claim 1, wherein the chassis further comprises at least one of registration pins and registration pin holes.

10. The adapter according to claim 1, wherein the adapter is spatially calibrated relative to a printer at the adapter manufacturing level and at least one of registration pins and registration holes are placed at locations determined by calibration/alignment process.

11. The adapter according to claim 10, wherein following calibration/alignment only the adapter is calibrated relative to the printer, wherein a batch of printheads directly attached to the adapter is automatically calibrated accordingly.

12. A method of printing with pigmented ink, comprising:

providing at least one pigmented ink recycling valve;

providing at least one pigmented ink supply valve communicating with an ink reservoir via an ink feeding tube and with at least one printhead accommodated in an adapter;

directing a flow of pigmented ink from the feeding tube to at least one of the at least one printhead and the pigmented ink recycling valve;

providing at least one washing solvent draining valve;

providing at least one washing solvent supply valve communicating with a solvent reservoir via a solvent feeding tube and with at least one printhead accommodated in the adapter; and directing a flow of solvent from the solvent supply valve through the at least one printhead to the washing solvent draining valve.

13. The method according to claim 12, wherein the pigmented ink comprises micro and/or nano-particles of at least one of pigment, glass and ceramics.

14. The method according to claim 12, further comprising continuously recycling the pigmented ink to maintain pigment particles in suspension.

15. The method according to claim 12, further comprising:

positioning the pigmented ink supply valve and the pigmented ink recycling valve in close proximity to printhead nozzles; and minimizing a volume of a column of ink between the valve and the printhead nozzles to a volume less than 5 ml.

16. The method according to claim 12, further comprising minimizing a volume of a column of ink between one of the valves and printhead nozzles to a volume less than 4 ml.

17. The method according to claim 12, wherein also minimizing a volume of a column of ink between one of the valves and printhead nozzles to a volume less than 3 ml.

18. The method according to claim 12, wherein the printhead comprises at least one main ink channel and at least one nozzle, and further comprising directing a flow of solvent through at least one of the main ink channel and the nozzle.

19. The method according to claim 12, wherein also at a manufacturing level:

spatially pre-calibrating the adapter relative to the printer; and placing at least one of registration pins and registration holes at locations determined by calibration/alignment process.

20. The method according to claim 12, further comprising:

directly attaching the at least one printhead to an insert; and spatially calibrating the printhead relative to the adapter so that when the adapter is calibrated relative to printer an attached batch of printheads is automatically calibrated accordingly.

21. An inkjet printhead adapter, comprising:

a chassis operative to accommodate at least one printhead, the chassis comprises:

at least one washing solvent draining valve;

at least one washing solvent supply valve communicating with a solvent reservoir via a solvent feeding tube and with the at least one printhead accommodated in the adapter, the solvent supply valve being operative to direct a flow of solvent from the solvent supply valve through the printhead to the washing solvent draining valve.

22. A method of printing with pigmented ink, comprising:

providing an inkjet printer including a printhead adapter, comprising:

a chassis operative to accommodate at least one printhead, the chassis comprising:

at least one washing solvent draining valve;

at least one washing solvent supply valve communicating with a the solvent reservoir via a solvent feeding tube and with the at least one printhead accommodated in the adapter; and directing a flow of solvent from the solvent supply valve through the at least one printhead to the washing solvent draining valve.

* * * * *